United States Patent [19]

Schmidt

[11] Patent Number: 4,884,319

[45] Date of Patent: Dec. 5, 1989

[54] APPARATUS FOR ARRESTING THE ROTARY TOWER OF A BALE OPENING DEVICE

[75] Inventor: Reinhard Schmidt, Gescher, Fed. Rep. of Germany

[73] Assignee: Hergeth Hollingsworth, GmbH, Duelman, Fed. Rep. of Germany

[21] Appl. No.: 255,808

[22] Filed: Oct. 11, 1988

[30] Foreign Application Priority Data

Oct. 12, 1987 [DE] Fed. Rep. of Germany ..... 3734484
Sep. 20, 1988 [DE] Fed. Rep. of Germany ..... 3831824

[51] Int. Cl.[4] ..... D01G 7/00
[52] U.S. Cl. ..... 19/80 R
[58] Field of Search ..... 19/80 R, 80 A

[56] References Cited

FOREIGN PATENT DOCUMENTS

| | | | |
|---|---|---|---|
| 2053948 | 6/1972 | Fed. Rep. of Germany | 19/80 R |
| 3335793 | 4/1985 | Fed. Rep. of Germany | 19/80 R |
| 3145424 | 6/1986 | Japan | 19/80 R |
| 3235529 | 9/1988 | Japan | 19/80 R |

*Primary Examiner*—Werner H. Schroeder

*Assistant Examiner*—Douglas E. Price

*Attorney, Agent, or Firm*—Cort Flint

[57] ABSTRACT

A bale opening device (1) for opening textile fiber material from fiber bales (9) and the like is disclosed which comprises a rotary tower (2) supported for pivotal movement about 180 degrees. The rotary tower reciprocates along a row of bales and has at least one cantilevered arm (3) carried by tower. Reducing unit (4) is carried by cantilevered arm (3) for reducing the bales while the tower reciprocates along the rows. Driving means (44, 45) is provided for causing the pivotal movement of the tower about 180 degrees. A rotary part which pivots with the tower, and a base plate (6) is fixed relative to the pivotal movement of the tower. A stop bar (31) is carried by one of the rotary part (5). A plurality of stop brackets (24, 25) are carried by the base plate cooperating with the stop bar. Arresting means is provided for stopping and braking the pivotal movement of the tower which includes brake means (44) for braking the tower against pivotal movement when the stop bar abuts against one of the stop brackets while a torque (44, 46) of the driving means is maintained.

17 Claims, 3 Drawing Sheets

APPARATUS FOR ARRESTING THE ROTARY TOWER OF A BALE OPENING DEVICE

BACKGROUND OF THE INVENTION

The invention relates to an apparatus for arresting the rotary tower of a bale opening device wherein the tower is pivotally supported about 180 degrees. A cantilevered arm which accommodates reduction elements and reciprocates along a row of bales is provided on at least one side of the tower. Stops are provided for limiting the rotational movement of the tower while the motor causing the rotation of the tower is controlled by limit switches.

In case of bale opening devices of the foregoing type, the rotary part of the tower is loaded relatively heavily in weight by the cantilevered arm or arms offset by 180 degrees. The arm or arms accommodate the reducing means, e.g. two milling rolls or the like, and the acceleration and retardation forces developing during the swivel movement and stopping of the tower are relatively high. For this purpose, a swivel drive having a relatively high transmission ratio is provided. for stopping the rotary tower upon a swivel movement, it has been known to use blocking means such as bolts dropping into a hole, retaining claws, etc. The positioning of the rotary tower at a stop point must be exact to ensure that it is free from play. Due to a longer service life, the blocking means are subjected to wear, e.g. by contamination, with a resultant increased play. An unfavorable influence is produced on the position of the rotary tower with respect to the carriage by which it is supported, and on the operation of the cantilevered arm containing the milling means. An exact lowering of the cantilevered arm and a perfect operation of the opening means is no longer ensured. Repairs are required on account of susceptibility to wear, and due to which the equipment must often be put out of action.

Accordingly, an object of the invention, in connection with the arresting of the rotary tower upon the swivel movement, is to render ineffective the unavoidable play concerning the braking assembly in the driving system and in the transmission members so that the rotary tower, including the cantilevered arm accommodating the reduction means, pivots between backlash-free positions during operation that are maintained.

SUMMARY OF THE INVENTION

The above, and other objects of the invention, are accomplished according to the invention by providing a stop bar secured to a rotary part of the tower which cooperates with stop brackets. With the use of a braking motor, the stop bar and brackets serve as the sole stopping means. With the movement of the rotary part of the rotary tower against one of the stops, the brake becomes effective while the torque of the driving means is maintained. It is important that according to the instant invention, blocking means or any expenditure for the control need not be provided. The difficulties and disadvantages involved do not arise. The tower is stopped without a backlash at the abutment. This is achieved quite simply by only the braking motor causing the swivel movement of the tower. It is only necessary to ensure that the positioning or the stopping of the tower at the abutment is achieved by pressure tension by a torque of the driving means becoming effective. By this means, the play at the abutment or stop, and also the play in the transmission gear and in other transmission members is eliminated. As a result, the operation may be free of wear. The sources of trouble existing up to now are excluded from the beginning. The positioning of the tower at the abutment is exact and steady.

It is possible by various means to press or keep pressed the rotary part of the tower against the abutment, while all transmission members between the braking motor and the abutment are maintained free from play. During the fixing of the tower in the stop position, a three-phase motor and gear may be under the action of an electromotive torque. Suitably, when the rotary tower moves to the stop, the motor brake first becomes operative, and directly afterwards, the three-phase motor is turned off. Apart therefrom, a mechanically produced torque may become effective by means of an additional working load of the driving means, while, upon disconnection of the motor, the motor brake is operated. Suitably, the working load is a fly wheel which may be provided on the free motor shaft. By the additional fly wheel mass, the three-phase motor may be kept pressed simultaneously by the electromotive and the mechanical pressure effect. The fly wheel mass may support the electromotive torque. Thus, the electric operation of the three-phase motor is saved.

Preferably, the rotary part of the tower is provided with two limit switches mounted diametrically with respect to each other, and with stationary trip cams. The positioning of the limit switches and trip cams with respect to the stop brackets should be such that the three-phase motor is disconnected shortly before the stop bar has reached the corresponding stop bracket. The three-phase motor may be stopped in advance of the respective stop bracket at a distance of a few millimeters only, e.g. of two to three millimeters. Upon the stopping of the motor at a distance from one of the stop brackets, it is connected again until the rotary part of the tower meets the stop bracket. If the rotary part is subsequently stopped by the motor brake prior to the disconnection of the three-phase motor on a short path, an electromotive overload of the three-phase motor is avoided. Further, the mechanically acting fly wheel mass additionally contributes to relieve the electromotive operation of the three-phase motor. Hence, a safe pressing of the rotary tower against the stop is ensured in a double manner.

Use is made suitably of a motor having a quick-motion winding and a slow-motion winding. The rotary tower may contain another switch provided with a stationary slide for switching the three-phase motor into the slow-motion phase. As a result, the stop position is approached in slow-motion mode of the motor. The reliability concerning a safe pressing of the rotary tower against the stop and the exclusion of any play with regard to stop and gear is increased. The stop bracket should be adjustable, e.g. by means of a setting screw. The stop bar should be of the angular type, wherein a bent-off portion projects into the area of the stop brackets.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
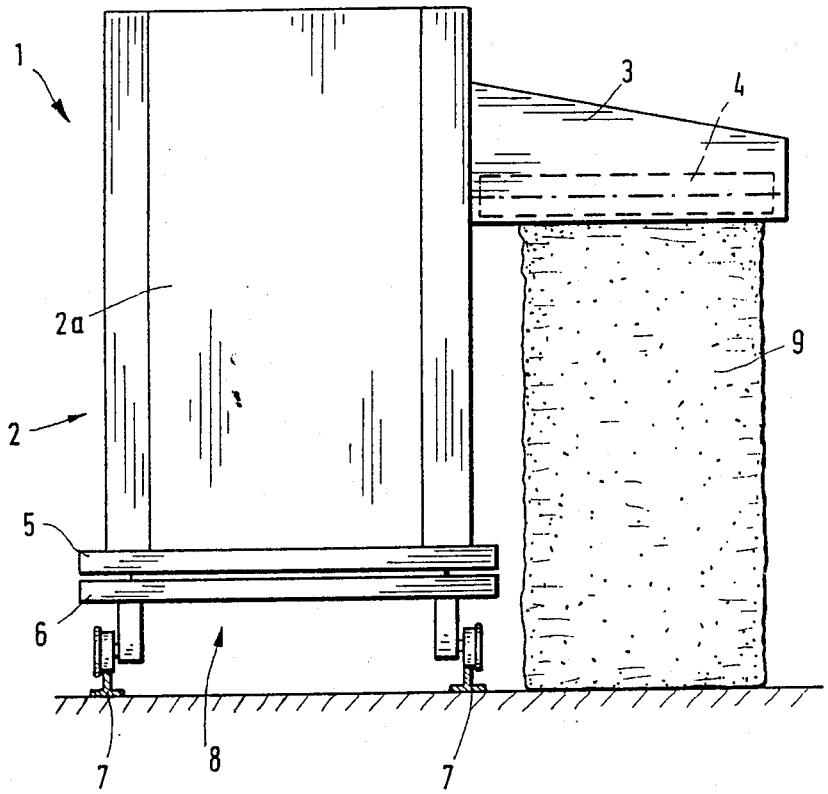
FIG. 1 is a schematic elevational view of a bale opening device with a rotary tower.
Figure 2:
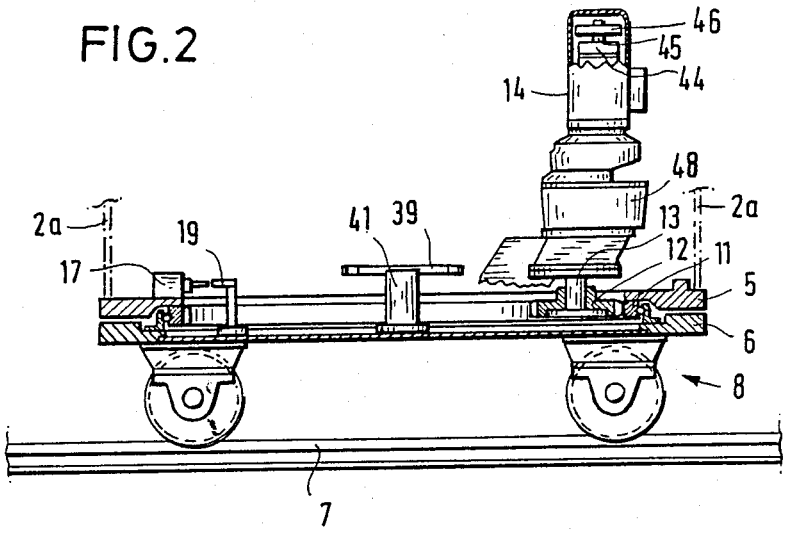
FIG. 2 is a schematic, partial cross-sectional view of the rotary tower which shows the elements required for the rotary drive of the tower.
Figure 3:
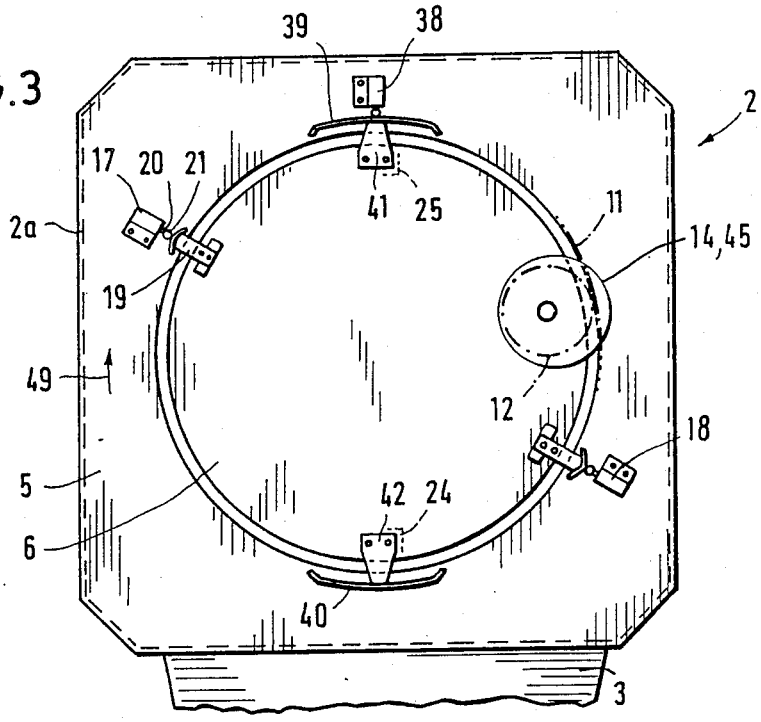
FIG. 3 is a schematic view from the top on the plate carrying the rotary drive and containing control and switch elements.
Figure 5:
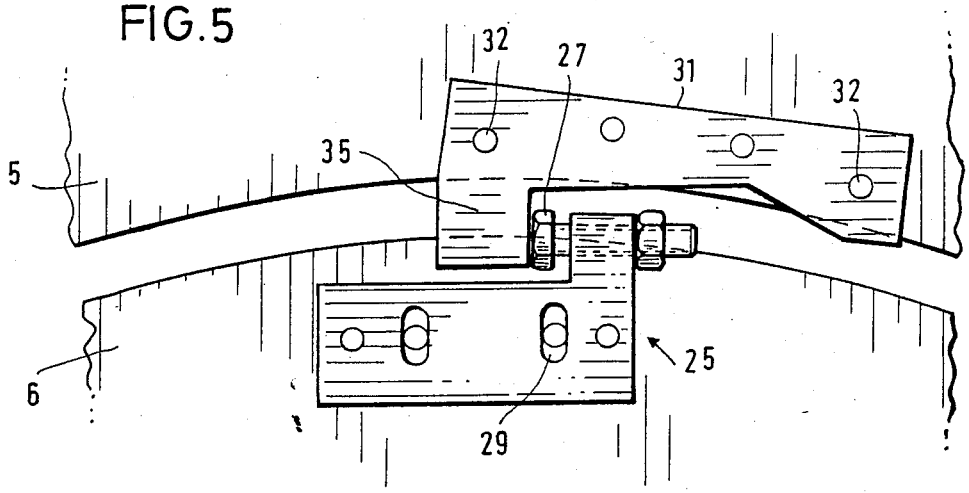
FIGS. 4 and 5 are details to show the scaled-up stop means.
Figure 4:
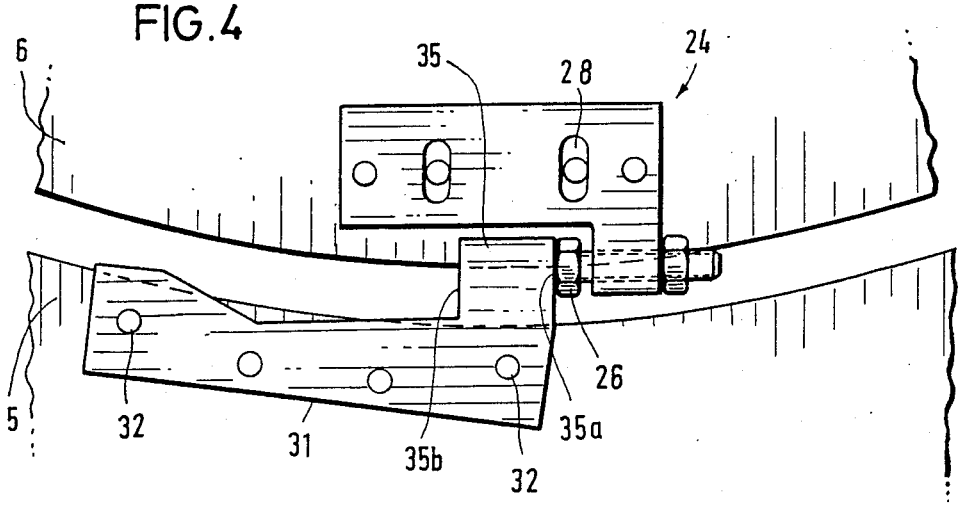

A fiber material opening means, designated generally as 1, comprises a rotary tower 2 having a cantilevered arm 3 in which reduction means, e.g. milling rolls 4, are accommodated. Housing 2*a* of the tower 2 is mounted on a plate 5 supported pivotally on a base plate 6. The parts form a carriage 8 adapted to reciprocate along rails 7. A bale row 9 set up parallel to the rails is reduced from the top by reducing means 3, 4. Cantilevered arm 3 is adjustable in height relative to the housing of tower 2. Base plate 6 of carriage 8 contains an internal gear ring 11 meshing with a gear 12 whose shaft is driven by a motor 14. The rotatable plate 5 of tower 2 may be turned by 180 degrees and back again. As a result, cantilevered arms 3, 4 may be swivelled by 180 degrees to either side of the opening means on which a row of fiber bales is set up and may be reduced by the same reduction means 3, 4.

Rotary plate 5 of tower 2 contains two limit switches 17, 18 adapted to cooperate with a trip cam 19 mounted on the stationary, non-rotatable base plate 6. The limit switches 17, 18 contain a displaceable lever arm 20 with a roll contact 21.

On stationary base plate 6, there are fixed stop brackets 24 and 25 disposed diametrically and including stop elements 26, 27 which, preferably are adjustable screw bolts. The stop brackets 24, 25 may be also adjusted radially by oblong holes 28 and 29.

A stop bar 31 is fixed by screws 32 on rotary plate 5, carrying tower housing 2 a with the cantilevered arms 3, 4. Stop bar 31 is provided with a stop member 35 projecting into the area of the stop brackets 24, 25. Stop member 35 of stop bar 31 abuts bracket 24 with one surface 35*a*. Upon a swivel movement by 180 degrees element 27 of bracket 25 abuts an opposite surface 35*b*.

On rotary plate 5 of tower 2, there is another switch 38 cooperating with slides 39, 40 fixed to stationary braces 41, 42. Switch 38 and slides 39, 40 are in one plane which is higher than the plane of trip cam 19 with which the switches 17, 18 are in cooperation. Upon the moving of the switch 38 onto the slide 39 or 40, the three-phase motor 14 is changed over into a slow-motion mode. As soon as switch 38 is no longer in cooperation with one of the slides, the three-phase motor 14 operates in quick-motion.

The three-phase motor 14 is provided with an electro-mechanical braking means 44. The three-phase motor has a motor shaft 45 with a working load 46 suitably in the form of a fly wheel. An external fan 47 may be provided on the motor shaft. Three-phase motor 14 is provided with a quick-motion winding and with a slow-motion winding. The change-over from one winding to the other may be generated. A toothed gearing is designated at 48 which is driven by three-phase motor 14.

When rotary plate 5 and tower housing 2a are swivelled clockwise, corresponding to arrow 49, switch 18 is tripped by cam 19, and the three-phase motor 14 is disconnected. The limit switches or trip cams are so positioned that the motor is disconnected shortly before stop bar 31 has reached stop bracket 25. Some distance in advance thereof, slide 40 has hit switch 38 to cause the change-over of three-phase motor 14 to the slow-motion mode. The distance of stop bar 31 from stop bracket 25 during the stopping of the motor is very short, only some millimeters, e.g. two to three millimeters. Upon the stopping of threephase motor 14 at this distance, it is shortly put into operation so that rotary plate 5 hits stop 27 of bracket 25 in slow-motion mode. Motor brake 44 of the motor 45 becomes operative and the motor is disconnected. As a result, rotary part 5 with tower housing 2*a* fully rests against stop 27. By the mass of fly wheel 46 seated on motor shaft 45, the generated contact pressure of the rotary plate against the stop is supported mechanically to a far extent. Play between the rotary plate and the stop and also in the gear parts of the gear 48 is eliminated and may not become effective. Rotary tower 5 is safely and reliably retained without any play in the swivelled position. The gear play may not act on the tower and the cantilevered arm containing the reducing means. Upon a back-swivel movement of the rotary tower by 180 degrees, the same conditions prevail between stop bar 31 and stop bracket 24.

While a preferred embodiment of the invention has been described using specific terms, such description is for illustrative purposes only, and it is to be understood that changes and variations may be made without departing from the spirit or scope of the following claims.

What is claimed is:

1. In a bale opening device for opening fiber bales and the like, said device having a rotary tower supported for pivotal movement about 180 degrees, which reciprocates on a carriage along a row of bales and is at least one cantilevered arm carried by said tower, and reducing means carried by said cantilevered arm for reducing said bales as said tower reciprocates along said row, stops for limiting the rotational movement of the tower, and a motor for causing the pivotal movement of the tower about 180 degrees wherein the improvement comprises:

a rotary part which pivots with said tower;

a nonpivoting base carried by said carriage;

a stop bar carried by said rotary part;

a plurality of stop brackets carried by said base cooperating with said stop bar;

electrical driving means for causing said pivotal movement; and stopping means for stopping the pivotal movement of said tower by braking said tower against pivotal movement with a brake when said stop bar of said rotary part abuts one of said stop brackets while the torque of said driving means is maintained.

2. The apparatus of claim 1 wherein said stopping means maintains an electromotive torque of said driving means in effect after said brake is engaged in response to said rotary part abutting one of said stop brackets and after said brake is engaged, said driving means is disconnected.

3. The apparatus of claim 2 including mechanical means for producing a mechanical torque in response to said stop bar connection with said driving means upon said rotary part abutting one of said stop brackets which is effective with said electromotive torque to assist in the stopping of said pivotal tower movement, said mechanical torque and brake being operative upon disconnection of said driving means.

4. The apparatus of claim 3 wherein said mechanical means includes a fly-wheel having a fly-wheel mass arranged on a free end of a motor shaft of said driving means for producing said mechanical torque.

5. The apparatus of claim 1 wherein said rotary part of said tower includes two diametrically disposed limit switches electrically connected to said driving means, trip cams for actuating said limit switches, and said limit switches and trip cams are disposed relative to said stop brackets so that said driving means is electrically disconnected shortly before said stop bar has reached said stop bracket.

6. The apparatus of claim 5 wherein said driving means is disconnected in advance of said stop bracket at a distance of about a few millimeters.

7. The apparatus of claim 5 wherein said driving means is again started after it has been stopped at said distance from said stop bracket until said rotary part abuts said stop bracket and a motor brake is applied to stop said rotary part prior to the disconnection of said driving means.

8. The apparatus of claim 5 wherein said driving means is started after reaching said distance from said stop bracket at a slow speed until contact between said stop bar and stop bracket occurs.

9. The apparatus of claim 1 wherein said rotary part includes a switch having a stationary slide for switching said drive motor into a slow-motion mode of operation.

10. The apparatus of claim 1 wherein said stop bracket is adjustable in its abutment position by said rotary part.

11. The apparatus of claim 1 wherein said rotary part includes a stop bar affixed to said rotary part having an angular projection which extends to an area of said stop brackets.

12. In a bale opening device for opening textile fiber material from fiber bales and the like, the combination comprising:

a rotary tower supported for pivotal movement about 180 degrees which reciprocates along a row of bales;

at least one cantilevered arm carried by said tower;

reducing means carried by said cantilevered arm for reducing said bales while said tower reciprocates along said rows;

driving means for causing the pivotal movement of the tower about 180 degrees;

a rotary part which pivots with said tower;

a base plate which is fixed relative to the pivotal movement of said tower;

a stop bar carried by one of said rotary parts or base plate;

a plurality of stop brackets carried by the other of said rotary part or base plate cooperating with said stop bar;

arresting means for stopping and braking the pivotal movement of said tower which includes brake means for braking said tower against pivotal movement when said stop bar abuts against one of said stop brackets while a torque of said driving means is maintained.

13. The apparatus of claim 12 wherein said torque is produced by means of an electromotive force of said driving means which is continued after said braking means is applied to said tower.

14. The apparatus of claim 13 wherein said torque is produced by means of a mechanical torque of said driving means which is continued after said braking means is applied to said tower.

15. The apparatus of claim 12 wherein said driving means causes the pivotal movement of said tower at a first speed; and said driving means is controlled by said arresting means to cause said tower to pivot at a second drive speed which is slower than said first drive speed in response to said tower reaching a predetermined distance from said stop bracket.

16. The apparatus of claim 12 wherein said driving means includes a three-phase electrical motor having a fast speed at which said tower is initially pivoted, and a slow speed at which said tower is pivoted prior to said stop bar reaching an abuting position wth said stop bracket.

17. The apparatus of claim 12 wherein said torque is produced by means of a mechanical torque of said driving means which is continued after said braking means is applied to said tower.

* * * * *